US006663214B1

(12) United States Patent
Chen et al.

(10) Patent No.: US 6,663,214 B1
(45) Date of Patent: Dec. 16, 2003

(54) MICRO LIQUID DISPENSER INCORPORATING A LIQUID PILLAR INJECTOR AND METHOD FOR OPERATING

(75) Inventors: Chung-Chu Chen, Taichung (TW); Chen-Kuei Chung, Tainan (TW); Shih-Hui Chen, Hsinchu (TW)

(73) Assignee: Industrial Technology Research Institute, Hsin Chu (TW)

( * ) Notice: Subject to any disclaimer, the term of this patent is extended or adjusted under 35 U.S.C. 154(b) by 0 days.

(21) Appl. No.: 10/197,321

(22) Filed: Jul. 16, 2002

(51) Int. Cl.[7] ..... B41J 2/015; B41J 2/04
(52) U.S. Cl. ..... 347/20; 347/54
(58) Field of Search ..... 347/20, 40, 44, 347/47, 54, 68, 56, 101, 105, 106

(56) References Cited

U.S. PATENT DOCUMENTS 5,154,905 A * 10/1992 Ohshima et al. ..... 423/335
5,420,613 A * 5/1995 Saisho et al. ..... 347/217
5,549,787 A * 8/1996 Sain et al. ..... 162/5
6,284,436 B1 * 9/2001 Ahn et al. ..... 430/320
6,415,995 B1 * 7/2002 Enderle et al. ..... 239/569
6,498,615 B1 * 12/2002 Chwalek et al. ..... 347/56
2002/0036144 A1 * 3/2002 Lee et al. ..... 205/296

* cited by examiner

*Primary Examiner*—Stephen D. Meier
*Assistant Examiner*—An H. Do
(74) *Attorney, Agent, or Firm*—Tung & Associates

(57) ABSTRACT

A micro liquid dispenser that incorporates a liquid pillar injector and a method for depositing liquid on a substrate by the micro liquid dispenser are disclosed. The micro liquid dispenser is constructed by a liquid storage chamber, a micro-actuator and an aperture formed in a semiconductor substrate, such as a silicon substrate. The method for depositing liquid on the substrate can be carried out by positioning a substrate juxtaposed to the aperture of the micro liquid dispenser and then actuating the actuator of the dispenser to inject a liquid pillar from the aperture toward the substrate. Only a tip portion of liquid pillar contacts and thereby attaches to the surface of the substrate while the remaining portion of the liquid pillar breaks off and retracted into the aperture or the liquid storage chamber of the dispenser.

17 Claims, 2 Drawing Sheets

MICRO LIQUID DISPENSER INCORPORATING A LIQUID PILLAR INJECTOR AND METHOD FOR OPERATING

FIELD OF THE INVENTION

The present invention generally relates to a micro liquid dispenser of a liquid pillar injector constructed of a liquid storage chamber, an actuator, and an aperture in a semiconductor substrate and a method for operating the dispenser. The invention further relates to a method for depositing liquid on a substrate by a micro liquid dispenser by first forming a liquid pillar and then contacting the tip of the pillar with the substrate such that only part of the liquid pillar is deposited on the substrate while the remaining liquid pillar is withdrawn into the dispenser.

BACKGROUND OF THE INVENTION

Since the advent of micro liquid dispensers, i.e., specifically for low cost printers for personal computers, a variety of inkjet printing devices have been developed and utilized in the industry. These inkjet printing mechanisms include the piezoelectric type, the electrostatic type and the thermal bubble type, etc. After the first thermal inkjet printer becomes commercially available in the early 1980's, there has been a great progress in the development of other printing technologies for applications in optoelectronics, biotechnology and biomedical applications.

In an inkjet printer, a liquid droplet injector is used as one of the key mechanisms. To provide a high-quality and reliable inkjet printer, the availability of a liquid droplet injector capable of supplying high-quality droplets at high-frequency and high-spacial resolution is critical.

Presently, there are two types of inkjet printers that are available in the marketplace, the piezoelectric type and the thermal type. The thermal inkjet system, also known as thermal bubble inkjet system, as thermally driven bubble system or as bubble jet system utilizes bubble to eject ink droplets out of an ink supply chamber, while piezoelectric printers utilize piezoelectric actuators to pump ink out from a reservoir chamber. The principle of operation for a thermal bubble inkjet system is that an electrical current is first conducted to the heater by an electrode to boil liquid in an ink reservoir chamber. When the liquid is in a boiling state, bubble forms in the liquid and expands and thus functions as a pump to eject a fixed quantity of liquid from the reservoir chamber through an orifice and then forms into droplets. When the electrical current is turned-off, the bubble generated collapses and liquid refills the chamber by capillary force.

When evaluating the performance of a thermal bubble inkjet system, factors such as droplet ejection frequency, cross-talk between adjacent chambers and the generation of satellite droplets are considered. Two of these performance factors, i.e. the satellite droplets, which degrade the sharpness of the image produced and the cross-talk between adjacent chambers and flow channels which decreases the quality and reliability of the inkjet system are frequently encountered. In order to improve the performance of a thermal bubble inkjet system, these drawbacks must be corrected.

For instance, in a traditional biotechnology micro-array fabrication, the technology of needle array spotting or micro stamping is normally utilized. U.S. Pat. No. 5,551,487 discloses a test slide preparation technique in which a contact-type needle or print head is used. The drawbacks of the systems include difficult waste disposal, time consuming cleaning of the needle or print head, and the large and variable dimensions of the print spot. Subsequently, the technique of inkjet printing is developed as disclosed in U.S. Pat. No. 6,341,840 of a inkjet-type substrate printing technique. While the new technique has the advantages of the non-contact, small specimen usage and fast fabrication speed; the inkjet technique has the drawbacks of requiring a large momentum to dislodge the ink droplets, such that droplets are ejected and fly for a long distance before impacting a substrate. Any deviation in the ejection angle of the droplets leads to a printing location error and thus limiting the printing resolution. Furthermore, the size of the droplets and satellite droplets developed further cause printing spot contamination or overlapping affecting the print quality.

It is therefore an object of the present invention to provide a micro liquid dispenser, particularly related to an inkjet head, that does not have the drawbacks or shortcomings of the conventional inkjet head.

It is another object of the present invention to provide a micro liquid dispenser that incorporates a liquid pillar injector for injecting a liquid pillar toward a substrate.

It is a further object of the present invention to provide a micro liquid dispenser that incorporates a liquid pillar injector constructed by a liquid storage chamber, and actuator and an aperture formed in a semiconductor substrate.

It is another further object of the present invention to provide a micro liquid dispenser that incorporates a liquid pillar injector utilizing a piezoelectric, electrostatic, thermoelastic, electromagnetic, or thermal bubble actuator to eject a pillar of liquid toward a substrate.

It is still another object of the present invention to provide a micro liquid dispenser that incorporates a liquid pillar injector suitable for depositing a liquid that has a viscosity smaller than 1000 poise onto a top surface of a substrate.

It is yet another object of the present invention to provide a method for depositing a liquid on a substrate by utilizing a micro liquid dispenser.

It is still another further object of the present invention to provide a method for depositing liquid on a substrate utilizing a micro liquid dispenser by positioning the substrate juxtaposed to the micro liquid dispenser at a distance smaller than a length of the liquid pillar ejected from the aperture.

It is yet another further object of the present invention to provide a method for depositing liquid on a substrate by a micro liquid dispenser by providing a top surface of the substrate coated with a hydrophillic agent at locations to be covered by the liquid.

SUMMARY OF THE INVENTION

In accordance with the present invention, a micro liquid dispenser incorporating a liquid pillar injector and a method for depositing liquid on a substrate by a micro liquid dispenser are disclosed.

In a preferred embodiment, a micro liquid dispenser incorporating a liquid pillar injector can be constructed by a liquid storage chamber for storing a liquid therein; an actuator for initiating a liquid dispensing action; and an aperture for forming a liquid pillar therethrough.

In the micro liquid dispenser, the actuator may be selected from the group consisting of a piezoelectric actuator, an electrostatic actuator, a thermoelastic actuator, an electromagnetic actuator and a thermal bubble actuator. The micro liquid dispenser further includes a semiconductor substrate onto which the liquid storage chamber, the actuator and the aperture are formed. The micro liquid dispenser may further include a silicon substrate onto which the liquid storage chamber, the actuator and the aperture are formed. The aperture may have a diameter smaller than a diameter of a print spot, or the aperture may have a diameter larger than a diameter of a print spot. The liquid stored in the liquid storage chamber may have a viscosity smaller than 1000 poise.

The present invention is further directed to a method for depositing liquid on a substrate by a micro liquid dispenser which can be carried out by the operating steps of providing a micro liquid dispenser equipped with a liquid storage chamber, an actuator and an aperture; providing a substrate that has a top surface for receiving a liquid; positioning the substrate juxtaposed to the micro liquid dispenser with the top surface of the substrate spaced apart from the aperture at a preset distance; actuating the actuator and injecting a liquid pillar from the aperture toward and until a tip of the liquid pillar contacts the surface of the substrate and thus depositing only partially the liquid pillar on the top surface of the substrate; and stopping said actuator and retracting partially the liquid pillar into the aperture and the liquid storage chamber.

The method for depositing liquid on a substrate by a micro liquid dispenser may further include a step of positioning the substrate juxtaposed to the micro liquid dispenser at a distance smaller than the length of the liquid pillar injected from the aperture. The method may further include the step of filling the liquid storage chamber with a liquid that has a viscosity less than 1000 poise. The method may further include the step of providing the substrate with a top surface selectively coated with a hydrophillic agent at locations to be covered by the liquid; or the step of providing the substrate with a top surface selectively coated with a hydrophobic agent at locations that are not to be covered by the liquid.

The method for depositing liquid on a substrate by a micro liquid dispenser may further include the step of depositing less than 50 vol. % of the total volume of the liquid pillar on the top surface of the substrate, or the step of depositing less than 30 vol. % of the total volume of the liquid pillar on the top surface of the substrate. The method may further include the step of retracting at least 50% of the total volume of the liquid pillar into the aperture and the liquid storage chamber; or the step of retracting at least 70% of the total volume of the liquid pillar into the aperture and the liquid storage chamber. The method may further include the step of providing the substrate with a top surface selectively treated with a hydrophillic agent selected from the group consisting of $NH_3$:$H_2O$:$H_2O_2$, $H_2SO_4$:$H_2O_2$ and polyethylene glycol. The method may further include the step of providing the substrate with a top surface selectively treated with a hydrophobic agent selected from the group consisting of hydrofluoric acid and dichloro-dimethyl-silane. The method may further include the step of providing the substrate having a top surface with a surface porosity of less than 10% of the total surface area.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1A:
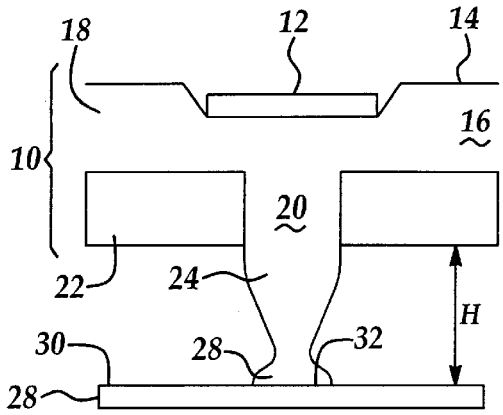
FIG. 1A is an enlarged, cross-sectional view of a first implementation example of the present invention method.

The present invention discloses a micro liquid dispenser incorporating a liquid pillar injector and a method for depositing liquid on a substrate by a micro liquid dispenser.

In the present invention micro liquid dispenser that uses a liquid pillar impact method, an actuator is used to push a liquid stored in a liquid storage chamber forming a liquid pillar. The actuator is designed such that while the liquid can be pushed through the aperture forming a liquid pillar, however, the liquid pillar does not separate from the aperture to form a liquid droplet. When a substrate is positioned under a present invention micro liquid dispenser at a distance smaller than the length of the liquid pillar, a front end of the liquid pillar strikes a top surface of the substrate such that the liquid pillar is partially attached to the substrate to accomplish the printing action. The remaining liquid not attached to the substrate then breaks off from the substrate and retracts back into the aperture of the micro liquid dispenser. The present invention micro liquid dispenser therefore presents several advantages over that of other types of inkjet printing heads, for instance, the present invention micro liquid dispenser has superior directional perpendicularity, a minute liquid dispensing amount, a precise liquid volume control, self-positioning or self-aligning to the printing spot, thus producing improved printing results at great energy savings.

The present invention micro liquid dispenser can be used in various applications such as in optoelectronic applications, biomedical applications and chemical applications. For instance, the present invention micro liquid dispenser can be used to fabricate flat display panels using OLED or PLED, color filters for the display panels and other micro-optical elements in biomedical applications. The invention can also be used in producing biological wafers and DNA/RNA/protein micro arrays.

The present invention micro liquid dispenser utilizing a liquid pillar impact method is constructed by a liquid storage chamber, an actuator and an aperture formed in a semiconductor substrate such as a silicon substrate. The actuator utilized may be a piezoelectric actuator, an electrostatic actuator, a thermoelastic actuator, an electromagnetic actuator or a thermal bubble actuator.

The aperture of the present invention micro liquid dispenser may have a diameter either smaller than the diameter of the printing spot, or larger than the diameter of the printing spot. The micro liquid dispenser is suitable for dispensing liquid that has the necessary fluidity in the liquid storage chamber or through the aperture for forming a liquid pillar. For instance, a liquid that has a viscosity smaller than about 1000 poise. The word "about" used in this writing indicates a range of value that is +/−10% of the average value given.

The present invention further discloses a method for depositing liquid on a substrate by a micro liquid dispenser which can be carried out by the operating steps of first providing a micro liquid dispenser that is equipped with a liquid storage chamber, an actuator and an aperture; providing a substrate that has a top surface for receiving a liquid; positioning the substrate immediately adjacent to the micro liquid dispenser with the top surface of the substrate spaced apart from the aperture at a preset distance; actuating the actuator and injecting a liquid pillar from the aperture toward and until a tip of the liquid pillar contacts the surface of the substrate and thus depositing only partially the liquid pillar on the top surface of the substrate; and stopping the actuator and retracting partially the liquid pillar into the aperture and the liquid storage chamber.

The preset distance between the top surface of the substrate and the aperture of the micro liquid dispenser should be smaller than the length of the liquid pillar produced (or injected) from the aperture such that the liquid pillar tip can reach the substrate and any separation of the liquid pillar from the aperture can be avoided. The top surface of the substrate may be selectively coated, i.e., at location of the printing spots, with a hydrophillic agent. A hydrophobic agent can be used to coat the top surface that is not to be covered by the liquid.

An important aspect of the present invention method is that only a partial volume of the liquid pillar produced from the aperture of the micro liquid dispenser is deposited, or attached to the top surface of the substrate. For instance, less than 50 vol. %, and preferably less than 30 vol. % of the total volume of the liquid pillar is normally attached to the top surface of the substrate. This indicates that at least 50 vol. %, and preferably at least 70 vol. % of the total volume of the liquid pillar is retracted into the aperture and the liquid storage chamber.

The hydrophillic agent utilized in the present invention novel method for coating the top surface of the substrate at the printing spots may be $NH_3$:$H_2O$:$H_2O_2$, $H_2SO_4$:$H_2O_2$ and polyethylene glycol. The coating process can be carried out by boiling the substrate with the printing spots exposed in a solution of $NH_3$:$H_2O$:$H_2O_2$, or in a solution of $H_2SO_4$:$H_2O_2$. The printing spots can also be treated with a solution of polyethylene glycol.

The hydrophobic agent utilized in the present invention for coating the top surface of the substrate at locations not to be printed may be a hydrofluoric acid or dichloro-dimethyl-silane. For instance, the hydrophobic agent can be applied by dipping the substrate with the spots not to be printed exposed in a solution of hydrofluoric (HF) acid or treated with dichloro-dimethyl-silane. The printing spot can be advantageously defined by using a photoresist layer, which is normally a hydrophobic agent. The present invention novel method is suitable for printing a substrate surface that is not highly absorbent of water. For instance, the present invention method may not be suitable for printing paper, cloth or other fabric type materials. A suitable substrate should have a top surface that has a surface porosity of less than 10% of the total surface area.

Referring now to FIG. 1A wherein a first implementation example of the present invention novel method is shown. The micro liquid dispenser 10, shown in FIG. 1A, is constructed by a micro actuator 12 situated on a top wall 14 formed in a semiconductor substrate 16 such as a silicon substrate. An opening, or an aperture 20 is formed in an insulating material layer 22, or in a metal layer. When a liquid pillar 24 is injected from the liquid storage chamber 18 through the aperture 20, and the top surface 30 of the substrate 28 is kept at a preset distance H from the aperture 20 smaller than the length of the liquid pillar 24, the tip 28 of the liquid pillar 24 touches the surface 30 of the substrate 28 and forms a printing spot 32.

Figure 1B:
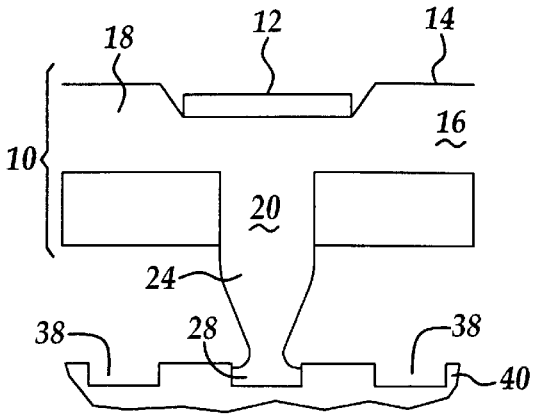
FIG. 1B is an enlarged, cross-sectional view of a second implementation example of the present invention method.

In another implementation example of the present invention method, shown in FIG. 1B, a substrate 40 that has a pre-defined printing site 38 is used for receiving the liquid pillar 24. The tip 28 of the liquid pillar 24 can thus be better positioned. The pre-defined substrate 40 may be colored spots on a face plate of a polymeric light emitting diode (PLED), or a test spot on a DNA micro array.

The present invention novel method for printing by a micro liquid dispenser is shown in FIGS. 2A~2D. For instance, the micro liquid dispenser 10 is first positioned juxtaposed to a substrate 40 with the top surface 36 of the substrate 40 spaced apart from the aperture at a preset distance H. The liquid storage chamber 18 is filled with a liquid 34 for forming subsequently a liquid pillar. Inside the dispensing site 38 may be coated with a hydrophillic agent. While a hydrophobic agent may be coated on surface 42 that is not to be coated with liquid 34. Before the activation of the actuator 12, shown in FIG. 2A, the liquid 34 is contained in the liquid storage chamber 18 forming a liquid front 44.

Figure 2A:
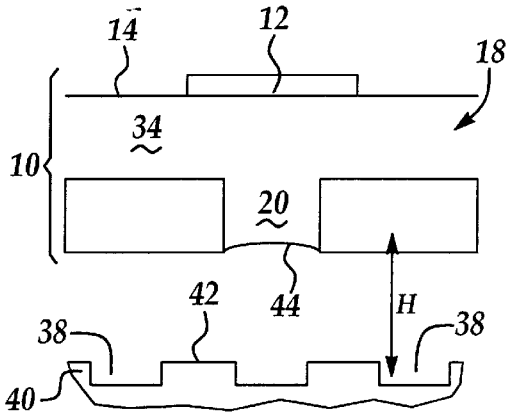
FIG. 2A is an enlarged, cross-sectional view illustrating the first step of the present invention method for depositing liquid on a substrate by a micro liquid dispenser.
Figure 2B:
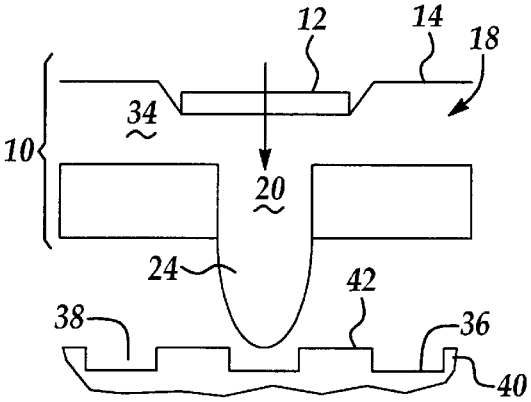
FIG. 2B is an enlarged, cross-sectional view of the second step of the present invention method for depositing liquid on a substrate by a micro liquid dispenser.

After the micro actuator 12 is actuated, as shown in FIG. 2B, the liquid 34 is pushed out of the liquid storage chamber 18 to form a liquid pillar 24.

Figure 2C:
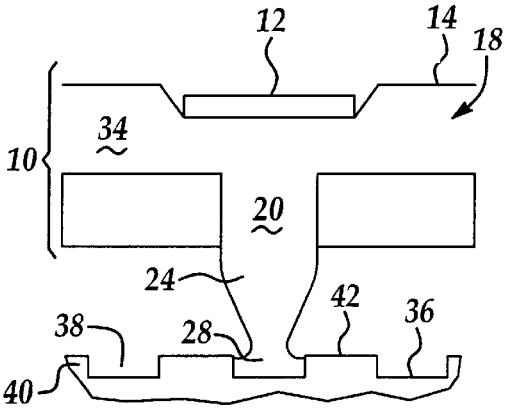
FIG. 2C is an enlarged, cross-sectional view illustrating the third step of the present invention method for depositing liquid on a substrate by a micro liquid dispenser.
Figure 2D:
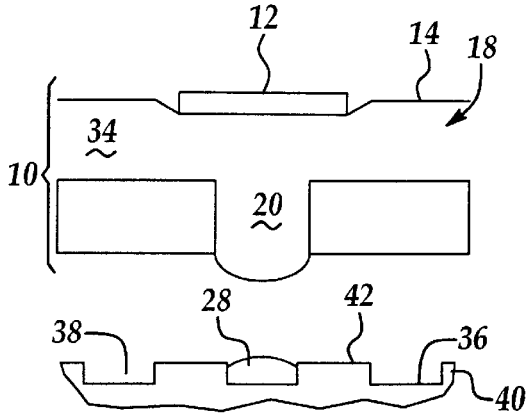
FIG. 2D is an enlarged, cross-sectional view illustrating the fourth step of the present invention method for depositing liquid on a substrate by a micro liquid dispenser.

After the tip 28 of the liquid pillar 24 touches the top surface 36 in the printing site 38 on the substrate 40, liquid 34 is attached to the surface 36 of the substrate 40. This is shown in FIG. 2C. After the attachment of the tip 28 of liquid 34 to the printing site 38, the micro actuator 12 is switched off, i.e., deactivated, as shown in FIG. 2D, such that a large portion of the liquid pillar 24 breaks off from the tip portion 28 and retracts into the aperture 20 and the liquid storage chamber 18. An accurate and liquid saving printing step has thus been completed by the present invention micro liquid dispenser 10.

Figure 3A:
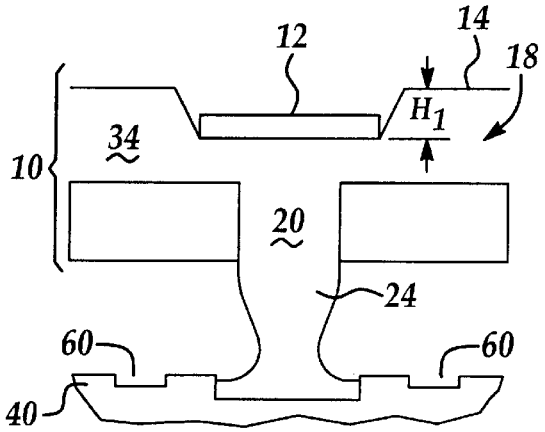
FIG. 3A is an enlarged, cross-sectional view when the present invention liquid pillar is used to print a large printing site.
Figure 3B:
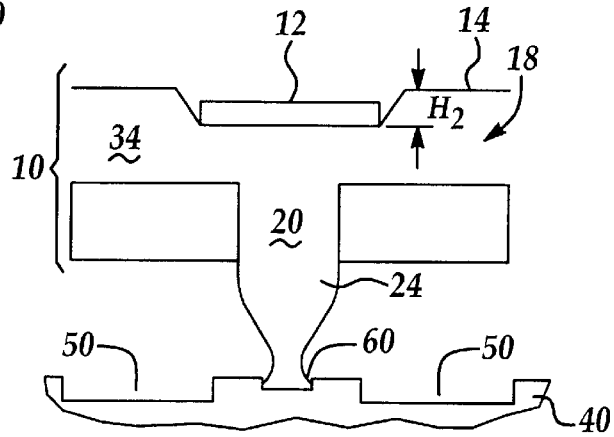
FIG. 3B is an enlarged, cross-sectional view of the present invention liquid pillar used to print a small printing site.

The present invention novel method may be advantageously carried out by using the same size aperture of a micro liquid dispenser to print, or to dispense liquid into dispensing site that are of different dimensions and of different depth. For instance, as shown in FIG. 3A, the present invention micro liquid dispenser 10 is used to dispense a liquid pillar 24 into a large dispensing site 50 when compared to FIG. 3B wherein a liquid pillar 24 is used to dispense into a small dispensing site 60. A large displacement $H_1$ of the micro actuator 12 may be required in dispensing into a large dispensing site 50, while a small displacement $H_2$ for the micro actuator 12 may be required to dispense into a small dispensing site 60. It is thus possible by controlling the degree of actuation of the micro actuator 12, suitable amount of the liquid 34 may be dispensed into a large dispensing site 50 or into a small dispensing site 60.

Figure 4:
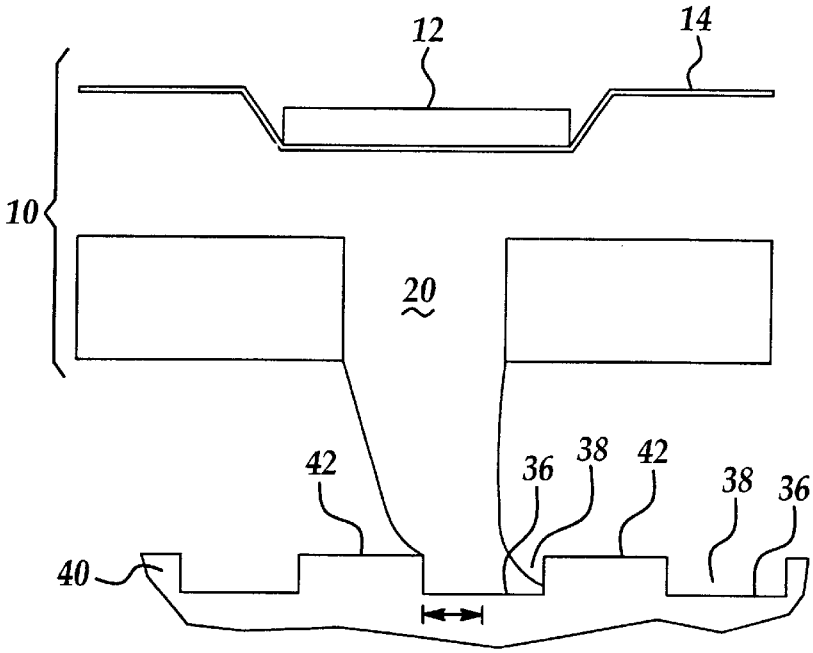
FIG. 4 is an enlarged, cross-sectional view illustrating the self-aligning effect of the present invention method for depositing liquid on a substrate by a micro liquid dispenser.

FIG. 4 is an enlarged, cross-sectional view of the present invention micro liquid dispenser 10 used in dispensing a liquid 34 illustrating the self-positioning, i.e., self-aligning advantage made possible by the present invention method.

For instance, when the dispensing surface 36 of the dispensing site 38 is coated with a hydrophillic agent, and the other surface area 42 are coated with a hydrophobic agent, the self-aligning effect of the present invention novel method is achieved. As shown in FIG. 4, a significant mis-alignment between the substrate 40 and the aperture 20 of the micro liquid dispenser 10 can be tolerated, as much as a half of the diameter of the aperture 20.

The present invention novel micro liquid dispenser and a method for depositing liquid onto a substrate by the micro liquid dispenser have therefore been amply described in the above description and in the appended drawings of FIG. 1A~4.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows.

What is claimed is:

1. A micro liquid dispenser incorporating a liquid pillar injector comprising:

a liquid storage chamber for storing a liquid therein;

an aperture for forming a liquid pillar therethrough;

a substrate having a top surface for receiving said liquid, the substrate being positioned juxtaposed to said micro liquid dispenser with said top surface of the substrate spaced apart from said aperture at a distance smaller than a length of a liquid pillar injected from said aperture; and an actuator for initiating a liquid dispensing action.

2. A micro liquid dispenser incorporating a liquid pillar injector according to claim 1, wherein said actuator is selected from the group consisting of a piezoelectric actuator, an electrostatic actuator, a thermoelastic actuator, an electromagnetic actuator and a thermal bubble actuator.

3. A micro liquid dispenser incorporating a liquid pillar injector according to claim 1, further comprising a semiconductor substrate onto which said liquid storage chamber, said actuator and said aperture are formed.

4. A micro liquid dispenser incorporating a liquid pillar injector according to claim 1, further comprising a silicon substrate onto which said liquid storage chamber, said actuator and said aperture are formed.

5. A micro liquid dispenser incorporating a liquid pillar injector according to claim 1, wherein said aperture having a diameter smaller than a diameter of a printing spot.

6. A micro liquid dispenser incorporating a liquid pillar injector according to claim 1, wherein said aperture having a diameter larger than a diameter of a printing spot.

7. A method for depositing liquid on a substrate by a micro-liquid dispenser comprising the steps of:

providing said micro liquid dispenser equipped with a liquid storage chamber, an actuator and an aperture;

providing said substrate having a top surface for receiving a liquid;

positioning said substrate juxtaposed to said micro liquid dispenser with said top surface of the substrate spaced apart from said aperture at a distance smaller than a length of a liquid pillar injected from said aperture;

actuating said actuator and injecting said liquid pillar from said aperture toward and until a tip of said liquid pillar contacts said surface of the substrate and thus depositing only partially said liquid pillar on said top surface of the substrate; and stopping said actuator and retracting partially said liquid pillar into said aperture and said liquid storage chamber.

8. A method for depositing liquid on a substrate by a micro liquid dispenser according to claim 7, further comprising the step of filling said liquid storage chamber with said liquid having a viscosity smaller than 1000 poise.

9. A method for depositing liquid on a substrate by a micro liquid dispenser according to claim 7, further comprising the step of providing said substrate with a top surface selectively coated with a hydrophillic agent at locations to be covered by said liquid.

10. A method for depositing liquid on a substrate by a micro liquid dispenser according to claim 7, further comprising the step of providing said substrate with a top surface selectively coated with hydrophobic agent at locations that are not to be covered by said liquid.

11. A method for depositing liquid on a substrate by a micro liquid dispenser according to claim 7, further comprising the step of depositing less than 50 vol. % of the total volume of said liquid pillar on said top surface of the substrate.

12. A method for depositing liquid on a substrate by a micro liquid dispenser according to claim 7, further comprising the step of depositing less than 30 vol. % of the total volume of said liquid pillar on said top surface of the substrate.

13. A method for depositing liquid on a substrate by a micro liquid dispenser according to claim 7, further comprising the step of retracting at least 50 vol. % of the total volume of said liquid pillar into said aperture and said liquid storage chamber.

14. A method for depositing liquid on a substrate by a micro liquid dispenser according to claim 7, further comprising the step of retracting at least 70 vol. % of the total volume of said liquid pillar into said aperture and said liquid storage chamber.

15. A method for depositing liquid on a substrate by a micro liquid dispenser according to claim 7, further comprising the step of providing said substrate with a top surface selectively treated with a hydrophillic agent selected from the group consisting of $NH_3$:$H_2O$:$H_2O_2$, $H_2SO_4$:$H_2O_2$ and polyethylene glycol.

16. A method for depositing liquid on a substrate by a micro liquid dispenser according to claim 7, further comprising the step of providing said substrate with a top surface selectively treated with a hydrophobic agent selected from the group consisting of hydrofluoric acid and dichlorodimethyl-silane.

17. A method for depositing liquid on a substrate by a micro liquid dispenser according to claim 7, further comprising the step of providing said substrate having a top surface with a surface porosity of less than 10% of the total surface area.

* * * * *